US005421987A

United States Patent [19]

Tzanavaras et al.

[11] Patent Number: 5,421,987

[45] Date of Patent: Jun. 6, 1995

[54] PRECISION HIGH RATE ELECTROPLATING CELL AND METHOD

[76] Inventors: George Tzanavaras, 2674 Park Wilshire Dr., San Jose, Calif. 95124; Uri Cohen, 765 San Antonio Rd., #53, Palo Alto, Calif. 94303

[21] Appl. No.: 113,945

[22] Filed: Aug. 30, 1993

[51] Int. Cl.[6] ..... C25D 3/56; C25D 5/08; C25D 5/02; C25D 7/00

[52] U.S. Cl. ..... 205/133; 205/134; 205/135; 205/143; 205/255; 205/238; 204/212; 204/224 R; 204/297 R

[58] Field of Search ..... 205/118–119, 205/133, 134, 143, 255, 135, 238; 204/212, 269, 273, 297 R, 224 R

[56] References Cited

U.S. PATENT DOCUMENTS

| | | | |
|---|---|---|---|
| 3,652,442 | 3/1972 | Powers et al. | 204/273 |
| 3,743,590 | 7/1973 | Roll | 204/212 |
| 3,963,588 | 6/1976 | Glenn | 205/133 X |
| 4,102,756 | 7/1978 | Castellani et al. | 204/123 X |
| 4,267,024 | 5/1981 | Weiskopf | 205/133 X |
| 4,279,707 | 7/1981 | Anderson et al. | 205/148 |
| 4,304,641 | 12/1981 | Grandia et al. | 205/96 |
| 4,359,375 | 11/1982 | Smith | 204/212 |
| 4,364,801 | 12/1982 | Salama | 205/133 X |
| 4,500,394 | 2/1985 | Rizzo | 205/133 |

OTHER PUBLICATIONS

Michael Matlosz, "Competitive Adsorption Effects in the Electrodeposition of Iron–Nickel Alloys", J. Electrochem. Soc., vol. 140, No. 8, Aug. 1993, pp. 2272–2279.

P. C. Andricacos et al., "Electrodeposition of Nickel–Iron Alloys", J. Electrochem. Soc., vol. 136, No. 5, May 1989, pp. 1336–1340.

*Primary Examiner*—Donald R. Valentine

*Attorney, Agent, or Firm*—Skjerven, Morrill, MacPherson, Franklin & Friel; David E. Steuber

[57] ABSTRACT

A precision high rate electroplating cell comprising a rotating anode/jet assembly (RAJA) immersed in the electrolyte and having high pressure electrolyte jets aimed at the substrate (cathode). The high pressure jets facilitate efficient turbulent agitation at the substrate's surface, even when it consists of complex shapes or mask patterns. High aspect ratio areas receive similar degree of agitation (and replenishment) as areas of lower aspect ratios. As a result, thickness and composition micro-uniformities are substantially improved while utilizing significantly higher current densities and plating rates.

28 Claims, 6 Drawing Sheets

PRECISION HIGH RATE ELECTROPLATING CELL AND METHOD

BACKGROUND OF THE INVENTION

1. Field of the Invention

This invention relates to a high rate electroplating cell suitable for electroplating alloys through patterned masks. In particular the cell is suitable for high speed plating of highly uniform Ni-Fe (permalloy) magnetic layers, through patterned masks, in the manufacturing of Thin Film Head (TFH) or Magnetic Bubble devices.

2. Background of the Invention

Precision electroplating often requires high degree of uniformities. These include thickness uniformity and, in the case of alloy plating, composition uniformity. Uniformities are further defined as macro-uniformity (over relatively large dimensions of about 1 cm, or larger, such as across a wafer), and micro-uniformity (over small dimensions of a few millimeters, or smaller, such as across an individual micro-device or a die). When plating an alloy through a patterned mask, such as a photoresist mask, composition non-uniformity is often encountered among opening areas of different aspect ratios. Such micro-non-uniformity is due to insufficient agitation and replenishment of the minor constituent(s) inside deep and narrow opening areas. An example of such a situation is the plating of Ni-Fe (permalloy) through a patterned photoresist mask in the course of manufacturing Thin Film Heads (TFH) or Magnetic Bubbles. In particular, plating the top pole layer in advanced TFH devices presents demanding challenges due to severe variations of the topography and aspect ratio across a device. While the narrow pole-tip (about 5–7 μm wide) is located on a flat surface, the wide (about 50–75 μm) back-yoke is located over an elevated step (comprising coil and insulation layers), about 10–15 μm above the pole-tip. The photoresist mask is only about 4–5 μm thick in the back-yoke area, but about 12–17 μm thick in the pole-tip area. Thus the aspect ratio, defined as the ratio between the vertical dimension (or thickness of the photoresist mask) to the lateral dimension of an opening, varies across a device from about 3:1 or greater in the pole-tip area to about 1:10 or less in the back-yoke area. This large variation in the aspect ratio across a device gives rise to severe composition micro non-uniformity. $Fe^{+2}$ ion concentration in the electrolyte is very low compared with the $Ni^{+2}$ ion concentration. The ratio between the two is typically only about 0.015–0.030. In comparison, the composition ratio between Fe and Ni in the deposit permalloy is about 0.20–0.25. As a result, stagnation and $Fe^{+2}$ ion depletion occurs to further extent in openings of larger aspect ratio than in openings of smaller aspect ratio. This leads to depletion of iron content in the plated Ni-Fe alloy at the pole-tip area, compared with the back-yoke area. Ni-Fe composition uniformity is critical for adequate TFH device performance. U.S. Pat. No. 3,652,442 to Powers et al. discloses a paddle cell designed to improve the uniformities of plated Ni-Fe in TFH devices. That patent advocates non-turbulent laminar flow of the electrolyte in the vicinity of the cathode (consisting of a wafer substrate) surface. However, with increasing aspect ratios of patterned features, non-turbulent laminar flow parallel to the cathode (or substrate) surface becomes ineffective for supplying fresh solution and replenishing the minor component(s) inside deep and narrow feature openings (having high aspect ratios). At the same time, wider feature openings with lower aspect ratios receive better supply and replenishment, resulting in poor composition micro-uniformity. In order to improve the composition micro-uniformity, the plating current density (and rate) must be reduced. The effect of current density on the various types of uniformities and the necessity to decrease it in order to improve the uniformities was disclosed in U.S. Pat. No. 4,102,756 to Castellani et al. and in U.S. Pat. No. 4,279,707 to Anderson et al. However, lower current density, or plating rate, results in lower throughput, thus adversely affecting the process economy.

In general, the uniformities degrade with increasing substrate dimensions and with decreasing feature size. These are precisely the current trends in the manufacturing of TFH and Magnetic Bubble devices. Larger wafers and smaller devices increase the number of devices per wafer, thereby reducing the processing cost per device. Smaller features are required to increase the recording density. Also, macro-non-uniformity of the current distribution across a wafer (such as due to radial distribution or edge or corner effects) leads to both thickness and composition macro-non-uniformities. A rotary (wafer or cathode) cell was disclosed by Grandia et al. in U.S. Pat. No. 4,304,641. That patent advocates nozzles of increasing size and uniformly spaced, or the same sized nozzles with decreasing radial spacing, in order to provide a differential radial flow distribution on the wafer-cathode. It provides increasing flow rate along the wafer's radius in order to improve thickness macro-uniformity. The technique relies on decreasing current efficiency with increasing flow rate, as described by Andricacos et al. in Journal Of Electrochemical Society, Vol. 136, No. 6, pp. 1336–1340 (1989). However, in addition to decreasing current efficiency, increase of the flow rate also results in sharp increase of the iron content in deposited permalloy film, as described by Andricacos et al. Uniformity of the permalloy composition is most critical for proper performance of the TFH device. The techniques disclosed in the Grandia patent were mainly applied in the fabrication of magnetic bubbles where the topography is relatively flat and the plated film thickness is less than 0.5 μm, thus requiring low aspect ratios. The technique may not provide sufficient agitation inside features with high aspect ratios such as in TFH devices and, therefore, does not improve micro-uniformities. The problem is particularly acute in areas near the center of the wafer, which receive reduced flow. The cell of the Grandia patent requires an even lower plating rate (about 0.05 μm/min) than the paddle cell of the Powers patent (about 0.09 μm/min) in order to maintain acceptable micro-uniformities. It does not offer an advantage, in this respect, over the paddle cell of the Powers patent.

SUMMARY OF THE INVENTION

The present invention provides a new plating cell design which significantly improves both macro and micro-uniformities (thickness and composition) while facilitating significantly higher current densities and plating rates. The plating cell of the invention incorporates a rotating anode/jet assembly (RAJA) producing high pressure and turbulent jets with a uniform flow distribution across the cathode (or substrate) surface. The RAJA comprises anode segments interposed between rows of jet nozzles. The anode segments are all connected to a common electrical conductor. Their shape and size are designed to maximize the total exposed anode surface area facing the cathode (or substrate) in order to minimize deleterious effects due to anodic polarization.

In one embodiment six anode segments, each having a shape of a pie-slice, are interposed between six radial rows of jet nozzles, forming a virtual anode circle. The anode sectors are connected to a common metal ring in their back side. The RAJA and the cathode (or substrate) are placed in the electrolyte in close proximity and facing each other, thereby providing high pressure jets of the electrolyte in a direction essentially normal to the substrate's surface. The impinging powerful jets create turbulent flow at the substrate's surface, thus providing efficient agitation and replenishment in all areas, including complex mask features with varying depth and opening sizes. High aspect ratio opening areas receive a similar degree of agitation (and replenishment) as areas of lower aspect ratios. Even features with the deepest and smallest openings (having the highest aspect ratio) receive essentially the same degree of agitation as areas of lower aspect ratios. This facilitates significantly improved micro-uniformities and allows a substantial increase of the plating rate. Each mask opening on the (stationary) substrate is subject to periodic pulsating jets produced by the RAJA. This pulsating action allows for pressure relaxation and outflow of depleted solution from the opening during periods when the jets are away. During periods when the jets are impinging on the openings, fresh solution is injected into the openings. The turbulent flow and pulsating action prevent the formation of stagnant (and depleted) electrolyte solution in deep and narrow mask openings. The frequency of the pulsating jets is determined by the rotating speed of the RAJA and by the number of jet nozzle rows on the RAJA.

The cell further incorporates an insulating hollow-ring collimating screen to mitigate edge and corner macro-non-uniformities. The collimating screen is placed between the (cathode) substrate and the RAJA. In addition, a current thief (or bias) is provided by placing a shaped conductive ring on the cathode holder assembly a few millimeters (e.g., 2–5 mm) outward and away from the edge(s) of the substrate (or wafer). The bias ring is electrically insulated from the substrate. Separate power supplies are used for the wafer and for the bias. The purpose of the bias ring is to control and reduce macro-non-uniformities due to the natural non-uniform current distribution near corners, edges, and along the radius of a wafer. In one embodiment, the positive terminals of both power supplies are connected to the anode (RAJA) and both power supplies are used in the constant current (CC) mode. The negative terminal of one power supply is connected to the wafer substrate (or cathode) and the negative terminal of the other power supply is connected to the bias ring. Best macro-uniformities are obtained when the responding voltages of the two power supplies are within about 0.2 V of each other.

An object of this invention is to provide an electroplating cell for plating alloys having superior macro and micro-uniformities at a high rate of processing.

A further object of the invention is to provide a rotating anode/jet assembly (RAJA) producing high pressure jets which create pulsating vigorous turbulent flow at the substrate surface. A further object is to prevent formation of depleted stagnant electrolyte solution inside deep and narrow mask openings (having high aspect ratios).

Another object is to provide means for high rate electroplating of highly uniform alloys through patterned masks.

Yet another object is to provide means for high rate electroplating of highly uniform permalloy (Ni-Fe) films, through complex patterned masks, in the manufacturing of TFH and Magnetic Bubble devices.

DESCRIPTION OF THE PREFERRED EMBODIMENTS

Figure 1:
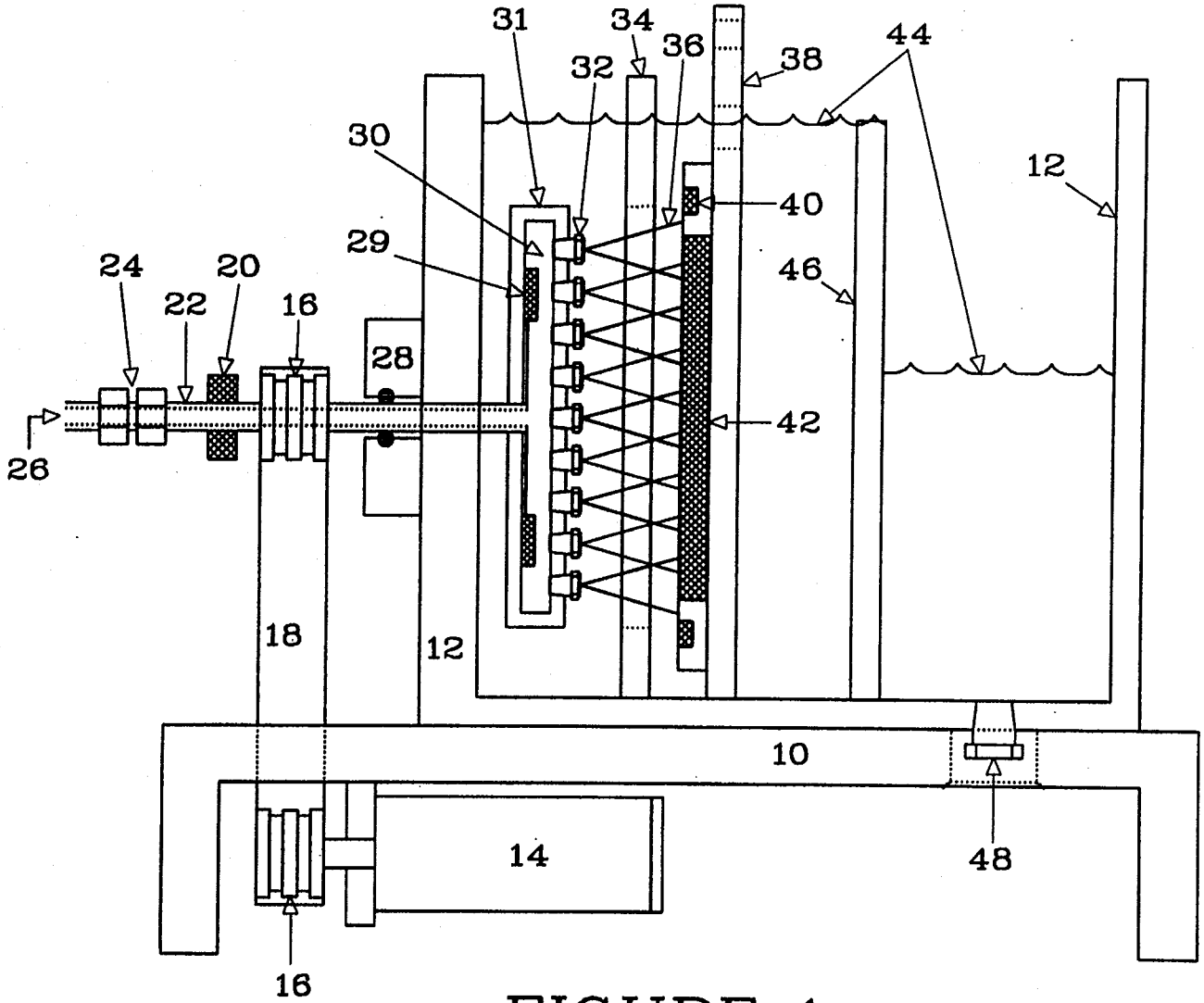
FIG. 1 shows a side cross-sectional view of the plating cell of this invention.

FIG. 1 shows a side cross-sectional view through the plating cell of the invention. A table 10 supports the main plating tank 12. A motor 14 activates pulleys 16 through a drive-belt 18 to rotate a pipe-shaft 22. Alternatively, pipe-shaft 22 can be coupled to motor 14, directly or by a variety of mechanisms, such as gears. Brush contacts 20 provide continuous electrical contact to the anodes (not shown) through rotating metal pipe-shaft 22. A plating solution or electrolyte 26 is pumped into a rotating fitting 24, and through it to rotating pipe-shaft 22, and on into a rotating anode/jet assembly (RAJA) 30. All anode sectors (see 54 in FIG. 3) are electrically connected at their back side to a common metal ring 29. The latter is electrically connected to metal pipe-shaft 22, thus providing continuous electrical path between contact brushes 20 and all anode sectors. Alternatively, if RAJA 30 is made of an inert metal or alloy, both metal pipe-shaft 22 and the anode sectors can be attached to it, thus providing electrical path between all anode sectors and contact brushes 20. All metal parts exposed to the electrolyte, except for the anode sectors, should be made of inert metals or alloys which do not react with or dissolve under anodic polarization into the electrolyte. Such metals may include Ti, Cr, Ta, Nb, W, Mo, Pd, Pt, Au, or alloys comprising one or more metals from this group. Exposed metal parts may include pipe-shaft 22, common ring 29, jet nozzles 32, and/or the support structure 31 of RAJA 30.

A high pressure pump (not shown) is connected on its intake side to a large reservoir tank (not shown) and on its exhaust side through one or more fine pore filter(s) (not shown) to rotating fitting 24. The pump provides a high pressure flow of filtered electrolyte 26 to rotating fitting 24. Rotating pipe-shaft 22 is inserted through a wall of the plating tank 12 via a rotating seal 28 equipped with an O-Ring. The pressurized electrolyte in RAJA 30 is injected through nozzles 32 to form powerful jets 36. Jets 36 have a fan-like shape or a conical shape and they partially overlap each other, as shown in FIG. 1. They impinge on the surface of a conductive substrate (or cathode-wafer) 42 in a direction substantially normal to the surface and create a substantially uniform flow distribution of electrolyte over the surface of substrate 42. Substrate 42 as well as a bias ring 40 are located on a wafer holder fixture 38, shown in more detail in FIGS. 2(*a*) and 2(*b*). When substrate 42 is completely immersed in electrolyte 44 it must be placed in close proximity to nozzles 32 in order to overcome the severe damping of the jets by the liquid bulk. For a typical pressure range of 30–50 psi at the inlet to rotating fitting 24, the distance between nozzle 32 and the surface of substrate 42 should be about 5–15 mm. Higher inlet pressure allows further separation, and vice versa. Alternatively, substrate 42 and RAJA 30 may be placed outside the electrolyte, or partially immersed in it. In such cases the distance between the RAJA and the substrate surface can be increased significantly. However, it is preferable to have both the RAJA and the substrate completely immersed in the liquid. The pressure of the impinging jets on the substrate's surface must not exceed a level which may damage the substrate's surface and/or the insulating plating mask overlaying it.

An insulating hollow collimating ring (or screen) 34 is placed between nozzles 32 and wafer 42. Collimating ring 34 is shown in more detail in FIGS. 4(*a*) and 4(*b*). Its purpose is to alleviate macro non-uniformities due to the substrate's edge and corner effects. Electrolyte level 44 is set in the main plating chamber by an overflow weir 46, and depends in the overflow chamber on the total flow rate and drain outlet opening 48. From drain 48 the electrolyte is circulated back into the reservoir tank (not shown). Continuous circulation of the electrolyte is maintained during the plating operation. Monitoring probes (not shown) for pH and temperature are placed in the overflow chamber.

The flow rate and/or pressure of electrolyte 26 at the inlet to the cell, as well the as rotation speed of pipe-shaft 22, are monitored and controlled. In addition, the temperature, pH, and concentration of $Fe^{+2}$ ions in the reservoir tank are continuously monitored and adjusted. Adjustable physical parameters include the distance between nozzles 32 and substrate 42, the rotation speed of RAJA 30, the location, shape, and dimensions of collimating ring 34, and the pressure (and/or flow rate) of electrolyte 26 at the inlet to the cell. In addition, separate power supplies individually control the currents (or voltages) to substrate (or wafer) 42, and to bias ring 40.

Figure 2A:
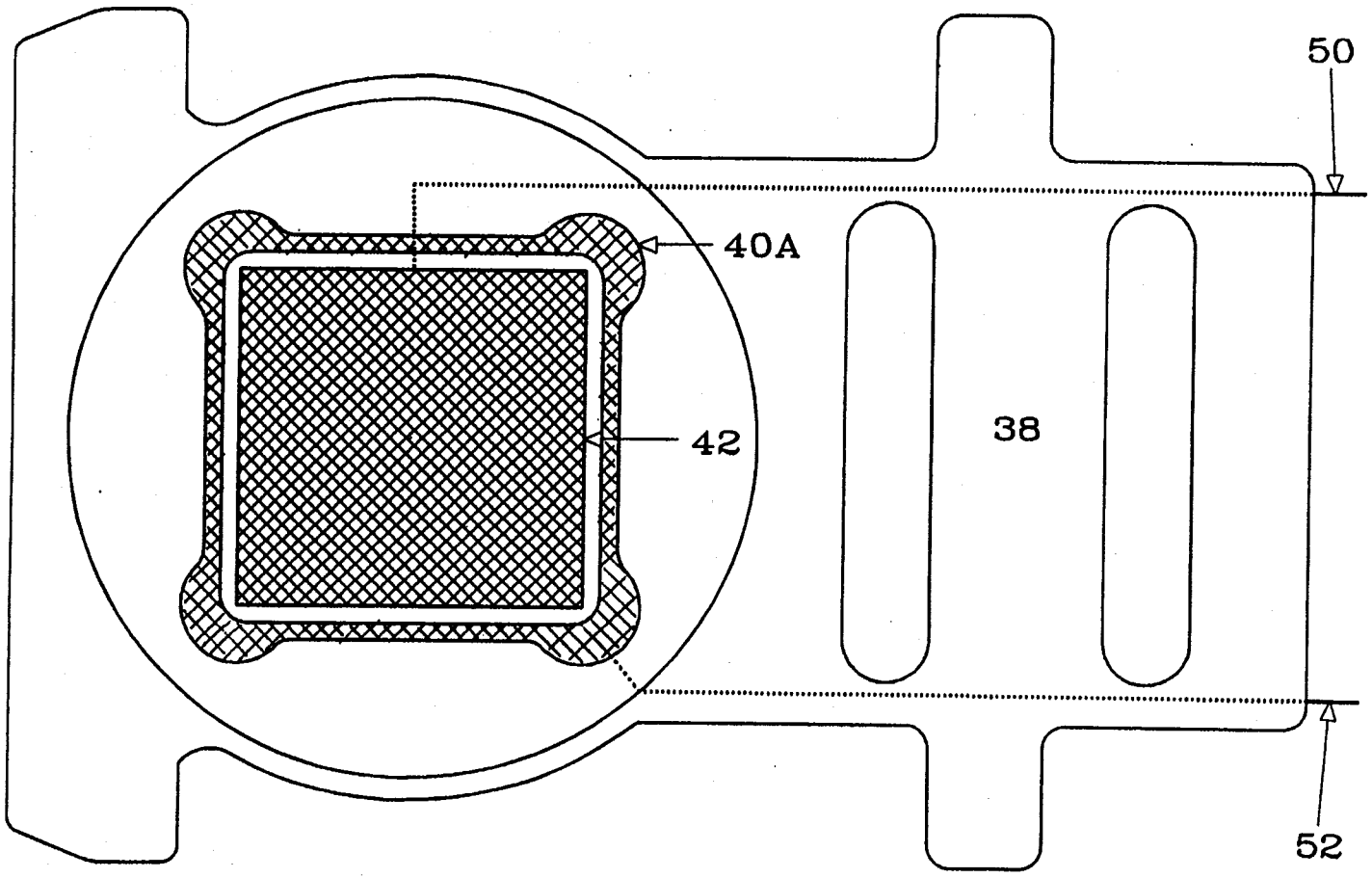
FIGS. 2(*a*) and 2(*b*) show a front view of the cathode (or wafer or substrate) holder and bias ring, for a square and a round substrate wafers, respectively.
Figure 2B:
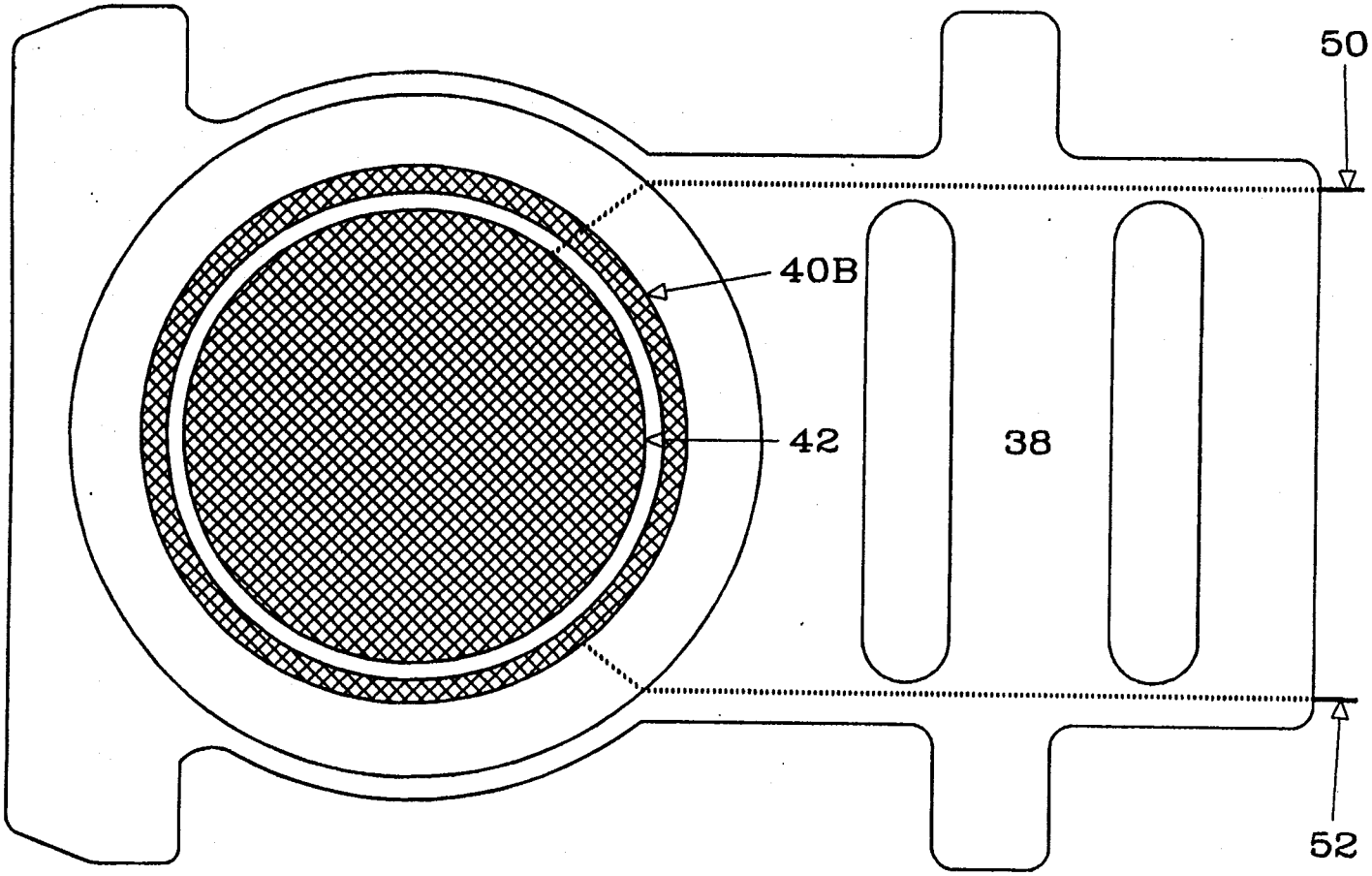

FIGS. 2(*a*) and 2(*b*) show a front view of the substrate (or cathode-wafer) holder fixtures for a square and a round wafer, respectively. Wafer holder fixture 38 is made of an insulating plastic, with an opening shaped to hold substrate 42. Substrate 42 is connected via an insulated electrical lead to an external (above the electrolyte level) contact 50.. Similarly, bias ring 40 is connected to an external contact 52. Conducting contact tabs or a ring (not shown) placed around the periphery of the opening in fixture 38 provide electrical contact to the wafer from its electrical lead 50. The location, shape, and dimensions of bias ring 40 relative to substrate 42 are important for achieving good macro-uniformities. Thus, FIG. 2(*a*) shows an adequate bias ring 40A for a square wafer, while FIG. 2(*b*) shows an adequate bias ring 40B for a round substrate. Intensified electric fields near edges and corners of the substrate give rise to higher local current densities, and accelerated plating rates, in these locations. These so called edge and corner effects cause severe macro-non-uniformities. The purpose of the bias ring is to divert excessive current density away from these vicinities. Enlarged areas near the corners of the bias ring 40A in FIG. 2(*a*) are designed to divert more current away from the vicinity of the wafer's corners.

Figure 3:
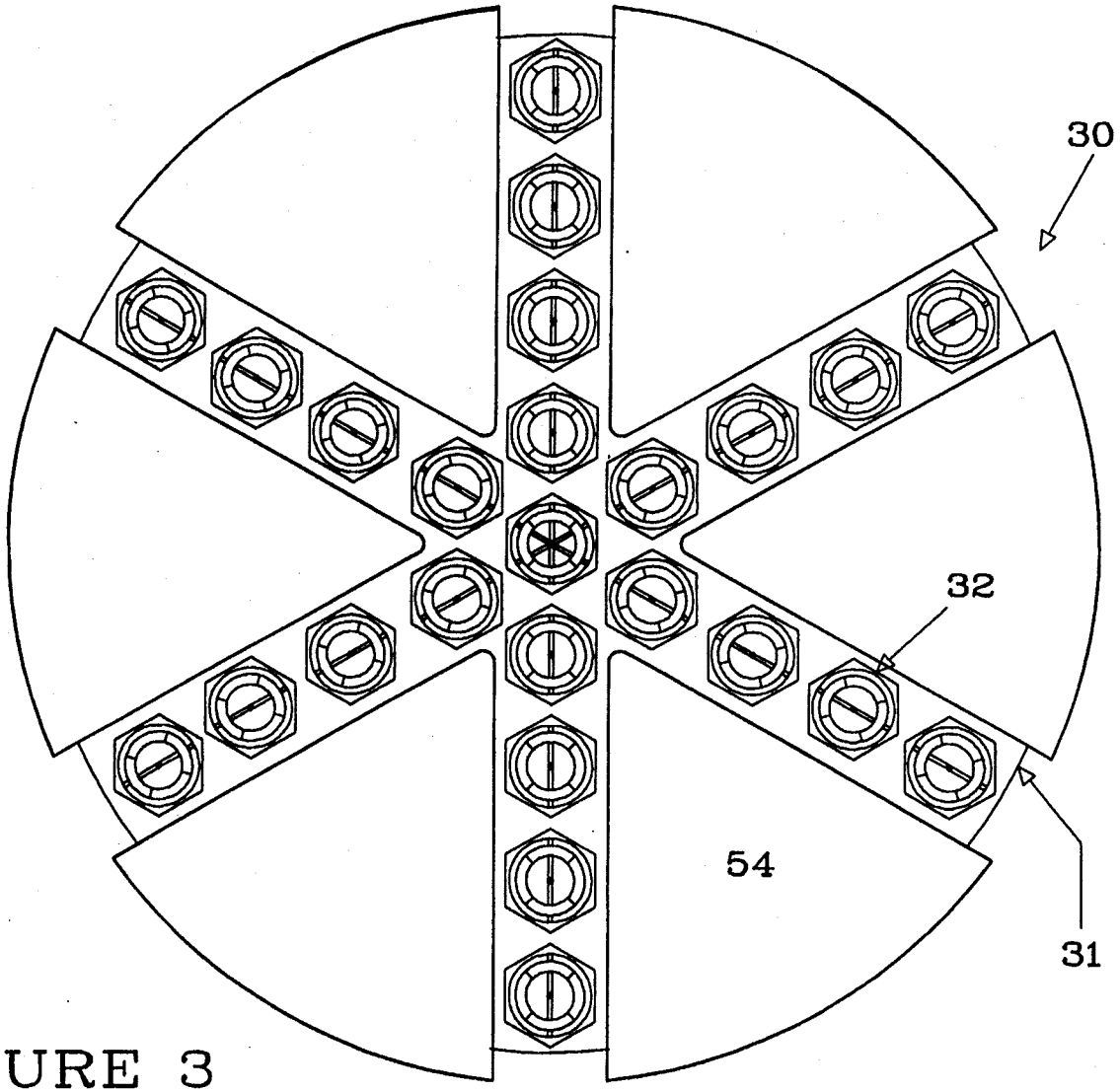
FIG. 3 shows a front view of the rotating anode/jet assembly (RAJA).

FIG. 3 shows a front view of the rotating anode/jet assembly (RAJA) 30. Nozzles 32 and anode sectors 54 are assembled on a support structure 31. The nozzles are arranged in radial rows over radial grooves or channels (not shown) which provide flow path for the pressurized electrolyte. Alternatively, support structure 31 includes a raised platen with a sealed enclosure underneath for the pressurized electrolyte, as shown in FIG. 1. Nozzles 32 and support structure 31 are preferably made of insulating plastic such as Teflon, Delrin, or polypropylene. Alternatively they can be constructed of inert metals or alloys which do not dissolve under anodic polarization into the electrolyte.

Nozzles 32 may have various jet shapes, such as circular cone or flattened cone (or fan-like). The central nozzle may require different flow rate and jet shape than the other nozzles. The reason is that areas located away from the substrate's center receive different number of jet pulses than the central area during each revolution of the RAJA. Assuming fan-like jet shape for all nozzles, the central area receives only two pulses per revolution while areas away from the center receive six pulses per revolution. If the central nozzle produces a jet with a symmetrical circular cone shape, then the central area of the substrate is subject to a continuous jet while the rest of the substrate is subject to multiple jet pulses during each revolution. In order to improve uniformity at the center of the substrate, the central nozzle may comprise multiple slots thus producing a jet shape with multiple flat-cones. The central nozzle may also require larger opening and faster flow rate (than the other nozzles) in order to accommodate the jet pressure of the multiple flat-cones. The number of the flat-cones and their orientation are preferably similar to the nozzle rows. Thus, as shown in FIG. 3, the central nozzle may comprise three slots, oriented at 120° to each other, and a larger opening for a higher flow rate. Alternatively, the central nozzle may be eliminated altogether by crowding adjacent nozzles near the center to ensure adequate jet coverage of the central substrate's area.

All anode sectors 54 are attached at their back side to a common metal ring (29 in FIG. 1) to provide electrical continuity through rotating metal pipe-shaft 22 to contact brushes 20 (in FIG. 1). Alternatively, if RAJA support structure 31 is made of an inert metal, it can provide direct electrical path between anode sectors 54 and metal pipe-shaft 22 and on to contact brushes 20 (in FIG. 1).

Figure 4A:
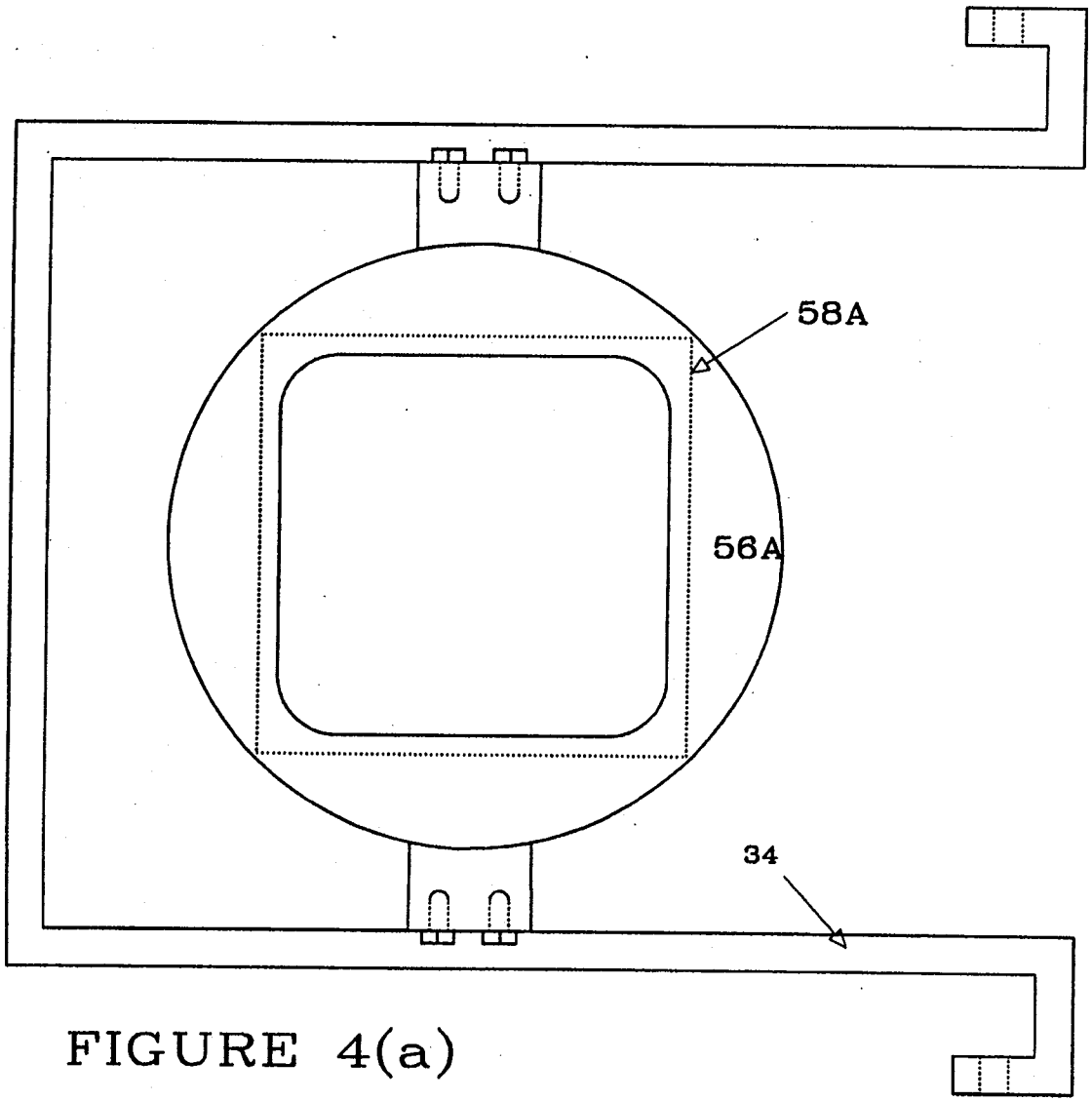
FIGS. 4(*a*) and 4(*b*) show a front view of collimating screens for square and round substrate wafers, respectively.
Figure 4B:
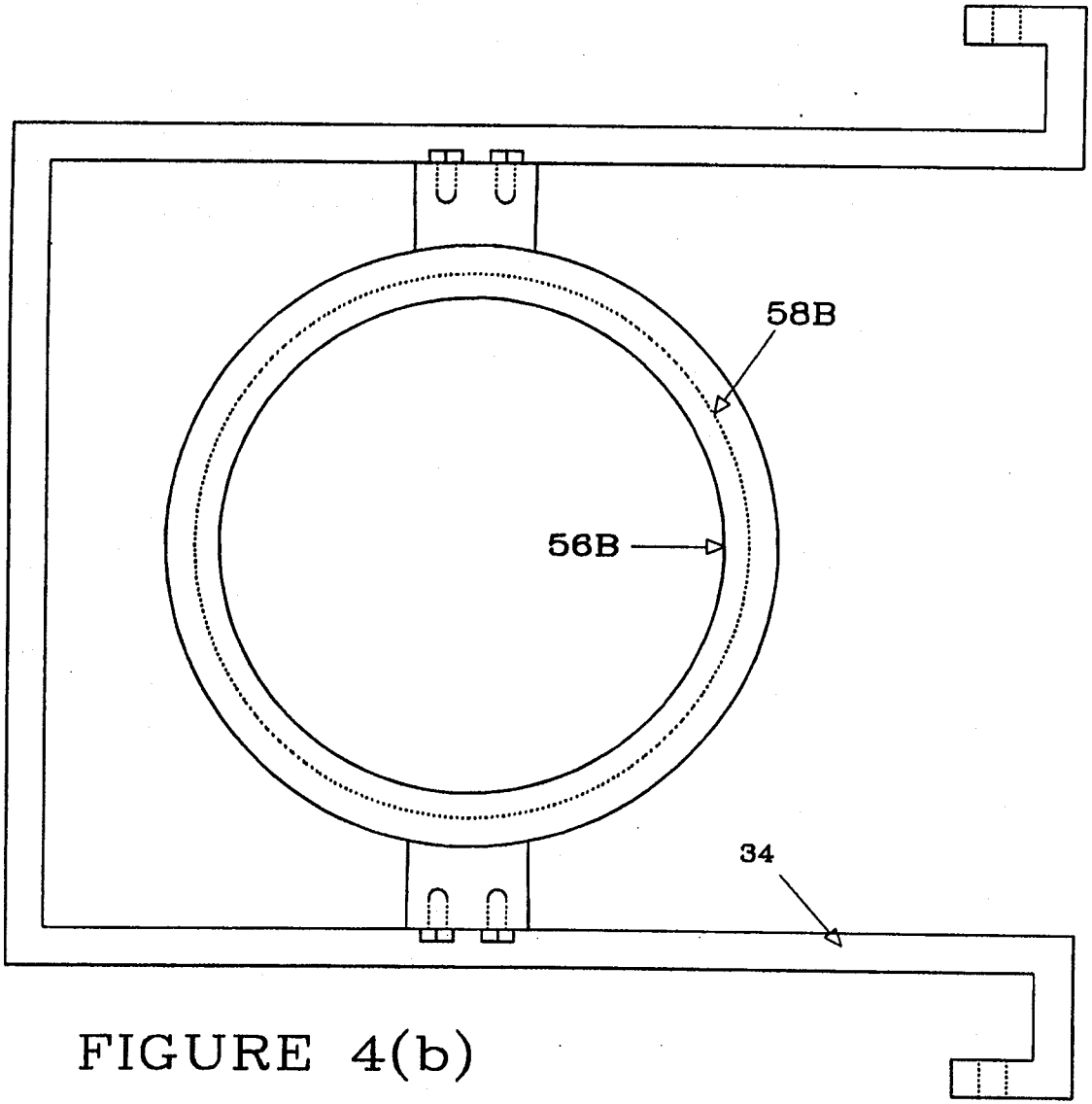

FIGS. 4(*a*) and 4(*b*) show a front view of collimating screens 56A and 56B for square and round substrates, respectively. The purpose of using the collimating screen is to further alleviate the plating edge and corner effects. Screens 56A and 56B are made of an insulating plastic material and can be readily removed from frame 34 by means of four screws. This allows simple replacement of the screen to fit the substrate to be plated. Dotted lines 58A and 58B represent the outline of the substrate. The actual dimensions and shape of screens 56A and 56B can be optimized by trial and error. The inside opening of screens 56A and 56B are typically a few millimeters inside the edge of the substrate in order to mitigate the plating edge effect. The inside opening of screen 56A for a square substrate includes rounded corners, as shown in FIG. 4(*a*), to further alleviate the plating corner effect. The distance of the screen from the substrate is adjustable by sliding and affixing frame 34 to the plating tank's walls. It can be optimized by trial and error, and is typically a few millimeters.

The plating cell of this invention offers simple operation combined with precise control and diverse flexibility. In a preferred embodiment, the cathode (or substrate) holder assembly is placed in a vertical and stationary position facing the RAJA, as shown in FIG. 1. This configuration facilitates ease of loading and removal of the substrate. In addition, a powerful flat stationary magnet (required for orienting an easy direction in the plated magnetic film) can be placed directly behind the substrate holder. Alternatively, a powerful stationary U-shaped permanent magnet (or electromagnet) can be placed outside the plating chamber and along its walls. Removing the heavy magnet from the cathode (or substrate) holder makes the latter much lighter and easier for handling. In comparison, rotating cathode assembly, such as described in U.S. Pat. No. 4,304,641, requires synchronous rotation of a heavy magnet behind the substrate, for oriented magnetic films (such as Ni-Fe). The heavy magnet encumbers the substrate holder and imposes severe restrictions related to the magnet cost, weight, and the uniformity and strength of its magnetic field. Also, the simple external electrical connections to the stationary substrate (or cathode) and bias ring of the present invention further facilitate the loading/unloading procedures and provide consistent and reliable contacts outside the electrolyte. In comparison, electrical contacts to rotating cathode (and bias) of U.S. Pat. No. 4,304,641 require slipping contacts inside the electrolyte, which may cause erratic contacts. With the stationary cathode (or substrate) and bias assembly of this invention, it is possible to place multiple substrates (each preferably surrounded by its own bias ring) on a common cathode(s) assembly holder facing a common RAJA. Alternatively, a single bias ring surrounding all the substrates may be used. Multiple orienting magnets can be placed directly behind each individual substrate for the multiple substrate holder. Alternatively, a single flat (and large) orienting magnet may be placed directly behind the multiple substrate holder, or a large U-shaped magnet (or electromagnet) may be placed externally along the walls of the plating chamber. All electrical contacts to the stationary multiple substrates (and bias rings) are made outside the electrolyte.

In addition to the usual parameters such as composition, pH, and temperature, the plating cell of this invention provides several other control parameters. For best performance, some parameters may require separate optimization for various substrate shapes and dimensions. The additional control parameters include: the currents $I_S$ and $I_B$ and/or voltages $V_S$ and $V_B$ applied by the power supplies to the substrate (cathode) and to the bias ring, respectively; the pressure and/or flow rate of the electrolyte into pipe-shaft 22; the distance between substrate and nozzles, $d_{SN}$; the distance between substrate and collimating screen, $d_{SS}$; the shape and dimensions of the collimating screen; rotation speed of RAJA; number of rows of jet nozzles on RAJA; distance between nozzles in a row; and the nozzles' jet shape and flow rate (at a given pressure).

In a preferred embodiment, two power supplies are operated at the constant current (CC) mode, and both positive terminals are connected to the anodes in the RAJA. The negative terminal of one power supply is connected to the bias ring, and the negative terminal of the other power supply is connected to the substrate (or cathode-wafer). Optimization of the macro-uniformities across the substrate or wafer surface is facilitated by the separate controls of the two power supplies. For any given plating rate (or substrate current) $I_S$, an optimum bias current $I_B$ is found (by trial and error) which will yield the highest degree of macro-uniformities across the substrate. The optimal bias current generates a bias voltage $V_B$ between the bias ring and RAJA which is similar to the substrate voltage $V_S$ between the substrate (wafer) and RAJA. For adequate uniformity, the difference between the two should be within about 0.2 volts. In another embodiment, at least one power supply is operated at the constant voltage (CV) mode. In yet another embodiment, one power supply is connected between the RAJA and substrate (as described above) and the other power supply is connected between the bias ring and the substrate in the constant voltage (CV) mode to maintain (or latch) a constant potential difference, $\Delta E_{BS}$, between the bias and substrate. The substrate power supply can be operated in either CC or CV mode, with its negative terminal connected to the substrate and its positive terminal to the RAJA. Note that in these schemes, the deposition rate determined by $I_S$ is the combined currents of both power supplies. Since $I_S$ may not be constant, it is best to include a quolometer to automatically terminate the plating at a preset value of charge. Other schemes may include the use of a three electrode Potentiostat/Galvanostat with a Reference Electrode for obtaining a very stable potential reference.

The pressure and flow rate of the electroplating solution through the nozzles are very important parameters. The pressure at the inlet to the nozzles 32 can be in the range of 10–80 psi (0.7–5.4 atm), and more preferably in the range 30–50 psi (2.0–3.4 atm). Total flow rate through the nozzles can be in the range of about 0.25–10.0 gallons per minute (GPM), and preferably in the range of 1.5–3.0 GPM. The distance between the surface of the substrate and the nozzles, $d_{SN}$, is typically in the range 2–40 mm, and preferably in the range of 5–15 mm. The distance between substrate and screen, $d_{SS}$, is typically in the range 1–15 mm, and preferably in the range of 2–5 mm.

Although preferred embodiments of this invention include the rotating anode/jet assembly (RAJA), other configurations may include a stationary anode/jet assembly with a rotating substrate assembly. Alternatively, both a RAJA and a rotating substrate assembly may rotate in the same or opposite directions. Similarly, RAJA configurations with other than multiple radial nozzle rows or with other number of rows may also be employed. For instance, the nozzles may be arranged in a jagged way, or lower number of radial nozzle rows, or even a single row, can be used with higher rotation speed.

EXAMPLES

Example 1

Ni-Fe (permalloy) was electroplated from an all-chloride bath containing:

| | |
|---|---|
| $NiCl_2.6H_2O$ | 109.00 g/l |
| $H_3BO_3$ | 25.00 g/l |
| $FeCl_2.4H_2O$ | 1.75 g/l |
| Na-Saccharine | 1.00 g/l |

-continued

| | |
|---|---|
| Na-Dodecyl Sulfate | 0.50 g/l |

Bath temperature was 28°±0.2° C., and the pH was 2.75±0.05. The substrate was a flat square ceramic wafer with dimensions of 4.5" on the side, and 0.105" thick. It was metallized prior to plating by sputter deposition of 1,000 Å thick Ni-Fe seed layer on the front surface. The RAJA was as shown in FIG. 3. All nozzles were identical, having a single slot producing fan-like jets. Flow rate through the nozzles was 1.8 gallons per minute (GPM) total, and the inlet pressure was about 35 psi. The RAJA rotation speed was 10 revolutions per minute (RPM). The separation between substrate's surface and nozzles was $d_{SN}$=20 mm. The separation between a round collimating screen and the substrate was $d_{SS}$=6.5 mm, and the screen had a round 6.0" diameter opening, as shown in FIG. 4(*b*). Both wafer and bias power supplies were operated in their constant current (CC) mode. The current settings were:

$I_S$=2.0 A $I_B$=1.9 A

The corresponding voltages varied between:

$V_S$=4.6–4.5 V $V_B$=4.7–4.6 V

Average thickness was 3.39 μm and the standard deviation across the wafer was 0.37 μm, or 10.9% thickness uniformity. Plating duration was 12 minutes. Thus the deposition rate was 0.28 μm/min. This rate is about three times faster than the conventional paddle cell. However, the thickness uniformity was not satisfactory.

Example 2

All parameters were kept similar to those of Example 1, except for the substrate and bias currents:

$I_S$=1.0 A $I_B$=0.8 A and the corresponding voltages:

$V_S$=3.1–2.8 V $V_B$=3.1–2.8 V

Average thickness was 6.10 μm and the standard deviation across the wafer was 0.27 μm, or 4.37% thickness uniformity. Plating duration was 32 minutes, and the plating rate was 0.19 μm/min. This rate is about twice as fast than the regular paddle cell with uniformity acceptable for most purposes.

Further improvements on a surface of a substrate patterned with a photoresist mask having a variety of feature openings with aspect ratios ranging from 1:10 or less to 3:1 or greater, can be achieved by utilizing parameters similar to those used in Example 1 but with the following changes: The single-slot central nozzle is replaced with a three-slot nozzle, as shown in FIG. 3, and the round collimating screen is replaced with a screen for a square wafer, as shown in FIG. 4(*a*). Also, the distance between substrate and nozzles is reduced to $d_{SN}$=9 mm, and the distance between substrate and collimating screen is reduced to $d_{SS}$=4 mm. These changes provide a high deposition rate of 0.28 μm/min (about three times faster than the paddle cell) with good uniformities of the top pole. They include thickness macro-uniformity (across the wafer) and thickness micro-uniformity (across a device) with a standard deviation of $1\sigma<5.0\%$, and composition macro-uniformity (across the wafer) and composition micro-uniformity (across a device between the pole-tip area and the back-yoke area) with standard deviation of $1\sigma<0.5\%$ Fe.

While the invention has been particularly described with reference to preferred embodiments, it will be understood by those skilled in the art that various changes in form and detail may be made therein without departing from the spirit, scope, and teaching of the invention. Accordingly, examples herein disclosed are to be considered merely as illustrative and the invention to be limited only as specified in the claims.

We claim:

1. An apparatus for electroplating a metal film on the surface of a substrate, said apparatus comprising:

a plating chamber adapted to contain an electroplating solution;

a cathode holder assembly for holding said substrate;

an anode/jet assembly adapted to face said substrate and having a plurality of nozzles arranged so as to direct jets of said electroplating solution toward the surface of said substrate at a direction essentially normal thereto;

a drive for causing relative rotation between said anode/jet: assembly and said cathode holder assembly; and a power supply for generating an electroplating current through said electroplating solution between said anode/jet assembly and said substrate, wherein said nozzles are configured so as to provide a substantially uniform flow distribution of said electroplating solution over the surface of said substrate as said relative rotation occurs between said anode/jet assembly and said cathode holder assembly.

2. The apparatus of claim 1 wherein said anode/jet assembly comprises a plurality of anode segments interposed between rows of jet nozzles, said anode segments being connected to a common electrical conductor.

3. The apparatus of claim 2 wherein said anode/jet assembly comprises six anode segments interposed between six radial rows of jet nozzles, each of said anode segments having a shape of a pie-slice.

4. The apparatus of claim 2 further including a conductive bias ring in said cathode holder assembly, located from 2 to 5 millimeters outward and away from the edge(s) of said substrate, said bias ring being insulated from said substrate.

5. The apparatus of claim 4 further including a second power supply for providing current between said bias ring and said anode/jet assembly.

6. The apparatus of claim 5 wherein, when said power supply and said second power supply are operational, the difference between (i) the bias voltage $V_B$ between said bias ring and said anode/jet assembly and (ii) the voltage $V_S$ between said substrate and said anode/jet assembly is 0.2 volts or less.

7. The apparatus of claim 6 wherein said power supply and said second power supply are both operated in the constant current mode.

8. The apparatus of claim 6 wherein at least one of said power supply and said second power supply is operated in the constant voltage mode.

9. The apparatus of claim 4 further including a second power supply wherein said second power supply is connected between said bias ring and said substrate and is operated in the constant voltage mode.

10. The apparatus of claim 2 further including a collimating screen positioned between said anode/jet assembly surface of said substrate.

11. The apparatus of claim 2 further comprising an insulating plating mask applied to the surface of said substrate having feature openings for exposing selected areas of said surface to said electroplating solution, said feature openings having aspect ratios which vary from 1:10 or less to 3:1 or greater.

12. The apparatus of claim 11 wherein said apparatus further comprises a pump, said pump providing sufficient pressure at said nozzles such that each of said mask openings receives repeated vigorous pulses of said electroplating solution as said anode/jet assembly is rotated.

13. The apparatus of claim 2 wherein said cathode holder assembly is for holding multiple substrates.

14. The apparatus of claim 2 wherein the surface of said substrate and said anode/jet assembly are adapted for complete immersion in said electroplating solution.

15. The apparatus of claim 2 wherein the surface of said substrate and said anode/jet assembly are adapted for partial immersion in said electroplating solution.

16. The apparatus of claim 1 wherein said drive is adapted to rotate said anode/jet assembly.

17. The apparatus of claim 1 wherein said drive is adapted to rotate said cathode holder assembly.

18. A method of electroplating a metal film on the surface of a substrate using an anode/jet assembly having an anode portion and a plurality of nozzles, said method comprising:

positioning said substrate near said nozzles such that a flow of an electroplating solution through said nozzles is directed substantially normal to said surface;

causing relative rotation to occur between said anode/jet assembly and said substrate;

supplying an electroplating solution to said anode/jet assembly such that a substantially uniform flow distribution of said electroplating solution strikes the surface of said substrate as said relative rotation occurs between said anode/jet assembly and said substrate, and generating an electroplating current through said electroplating solution between said anode/jet assembly and said substrate.

19. The method of claim 18 wherein said electroplating solution comprises a solution of nickel and iron ions for electroplating a film of Ni-Fe alloy on the surface of said substrate.

20. The method of claim 19 wherein an insulating plating mask is applied to the surface of said substrate, said plating mask having feature openings which expose selected areas of said surface to said electroplating solution, said feature openings having aspect ratios which vary from 1:10 or less to 3:1 or greater.

21. The method of claim 20 wherein the surface of said substrate is positioned at a distance of from 2 to 40 millimeters from said nozzles and said electroplating solution has a pressure of from 10 to 80 psi before it flows through said nozzles.

22. The method of claim 21 wherein said distance is from 5 to 15 millimeters and said pressure is from 30 to 50 psi.

23. The method of claim 22 wherein the thickness of said Ni-Fe alloy film has macro and micro uniformities with a standard deviation of less than or equal to 5%.

24. The method of claim 22 wherein the composition of said Ni-Fe alloy film has macro and micro uniformities with a standard deviation of less than or equal to 0.5% Fe.

25. The method of claim 24 wherein said Ni-Fe alloy film is formed at a rate of at least 0.19 μm/minute.

26. The method of claim 25 wherein said Ni-Fe alloy film is formed at a rate of at least 0.28 μm/minute.

27. The method of claim 18 wherein said anode/jet assembly rotates about an axis, said substrate being held stationary.

28. The method of claim 18 wherein said substrate rotates about an axis, said anode/jet assembly being held stationary.

* * * * *